United States Patent [19]

Gibbs

[11] 4,243,217

[45] Jan. 6, 1981

[54] EXERCISING APPARATUS

[76] Inventor: David J. Gibbs, 6, Linden Close, Green Park, Wootton Bassett, Swindon, Wiltshire, England

[21] Appl. No.: 896,336

[22] Filed: Apr. 13, 1978

[51] Int. Cl.[3] ..... A63B 69/16

[52] U.S. Cl. ..... 272/73; 272/DIG. 4; 188/80; 188/174

[58] Field of Search ..... 272/73, DIG. 3, DIG. 4, 272/DIG. 5; 73/379, 380, 381; 188/29, 57, 174, 231, 80, 262

[56] References Cited

U.S. PATENT DOCUMENTS

| | | | |
|---|---|---|---|
| 2,788,211 | 4/1957 | Ivanoff | 272/73 |
| 3,107,915 | 10/1963 | Looney | 272/73 |
| 4,082,265 | 4/1978 | Berkes | 272/73 |

FOREIGN PATENT DOCUMENTS

| | | | |
|---|---|---|---|
| 848630 | 7/1939 | France | 188/80 |
| 857814 | 4/1940 | France | 272/73 |
| 2271554 | 12/1975 | France | 272/73 |
| Ad.10917 | of 1884 | United Kingdom | 188/262 |
| 268621 | 4/1927 | United Kingdom | 188/174 |
| 521467 | 5/1940 | United Kingdom | 272/73 |

OTHER PUBLICATIONS

Columbia Cycle Exerciser "Super", The Columbia Manufacturing Co., Inc., Westfield, Mass., 1966.

*Primary Examiner*—Richard C. Pinkham
*Assistant Examiner*—Arnold W. Kramer
*Attorney, Agent, or Firm*—Young & Thompson

[57] ABSTRACT

A cycling exerciser comprises a frame within which is mounted a pedal-driven wheel. A lever carrying a pair of rollers is pivotally mounted on the frame and the rollers are biased into engagement with the wheel by means of a weight also carried by the lever. The position of the weight along the lever is adjustable so as to adjust the degree of bias and thereby regulate the resistance to rotation of the wheel provided by the rollers.

5 Claims, 2 Drawing Figures

EXERCISING APPARATUS

This invention relates to exercising apparatus and is concerned with the provision of a cycling exerciser which is capable of more versatile usage than such apparatus at present in use.

According to the invention there is provided a cycling exerciser which includes a pivotally mounted lever biased into engagement with a driven wheel of the exerciser and means for adjusting the bias.

A pair of rollers are preferably carried by the pivotally mounted lever and are arranged so that they rest on the periphery of the wheel at positions substantially equi-angularly spaced from the uppermost point of the wheel. Engagement of the periphery of the wheel by the rollers simulates the contact obtained during road usage between the wheel and the road surface. The wheel may be a conventional cycle wheel fitted with a pneumatic tyre, and in this case it is preferred that the tyre pressure should be somewhat greater than would normally be the case for a bicycle.

Adjustment of the degree of bias may be obtained by mounting a weight on the lever and providing for movement of the weight along the lever relative to a graduated scale. Provision may be made for holding the weight in a desired adjusted position and this may be achieved by arranging for the weight to have threaded engagement with a rod rotatable relative to the lever, the lever including a pair of side plates between which the rod is disposed. The rod preferably has a knob or other manually grippable element at its free end and the arrangement will be such that, as the rod is turned, the weight is moved longitudinally of the lever, the weight being prevented from turning with the rod by virtue of its engagement with the lever side plates.

Figure 2:
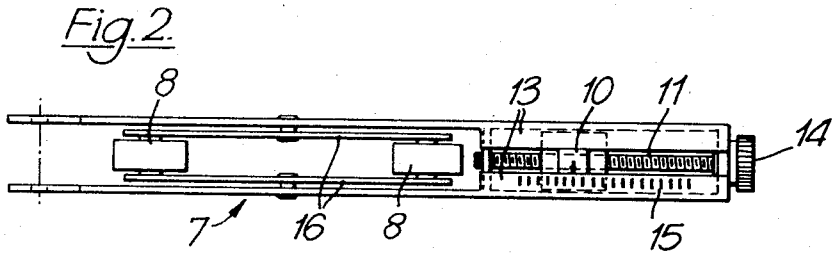
Figure 1:
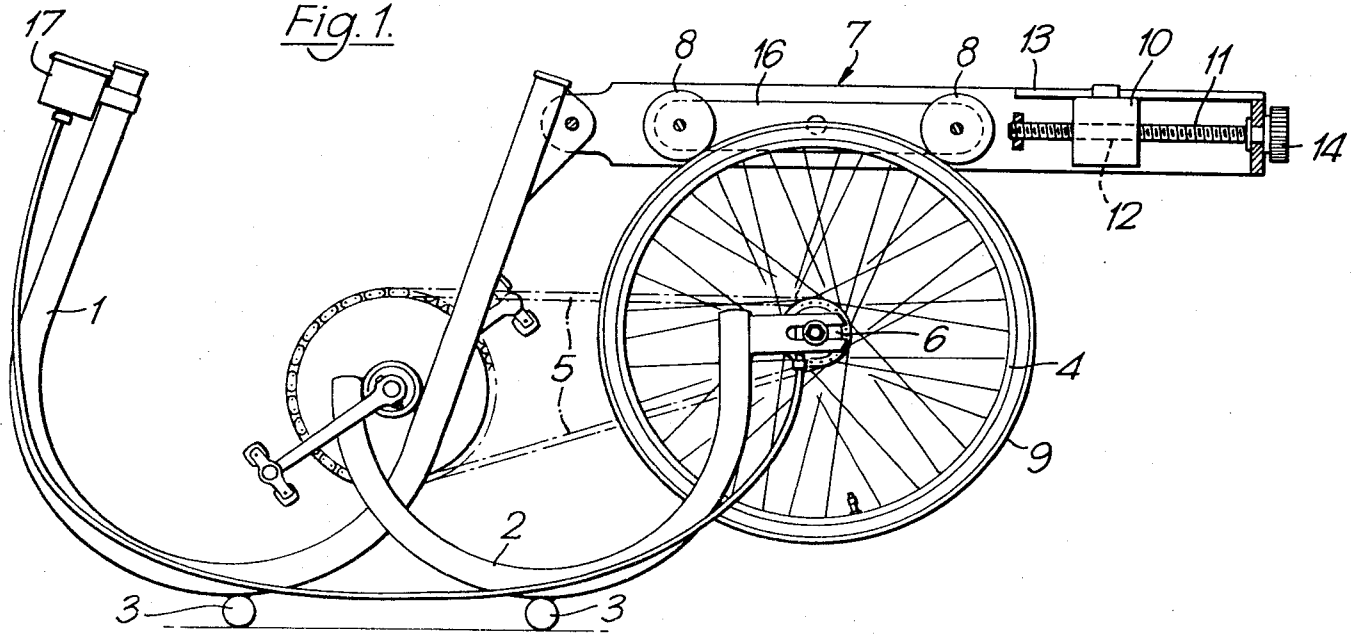

A cycling exerciser in accordance with the invention will now be described, by way of example, with reference to the accompanying drawings, in which:

FIG. 1 is a diagrammatic side view of the exerciser but without the handlebar and saddle that will normally be provided, and FIG. 2 is a plan view of a pivotally mounted lever of the exerciser.

The frame of the exerciser consists of two U-shaped tubular metal elements 1 and 2 attached to a base 3 so as to support a driven wheel 4 of the exerciser clear of the base 3. The wheel 4 is driven through a pedal-operated chain drive mechanism 5 which incorporates a gear-change mechanism 6. A lever 7 is pivotally connected to the rear of the foremost U-shaped element 1 and comprises a pair of spaced parallel side plates 13. A pair of rollers 8 are rotatably mounted one at each end of a sub-frame 16, which is pivoted at its centre between the side plates 13, and are biased into engagement with the driven wheel 4. The rollers 8 are arranged so that they rest on the tyre 9 of the wheel 4 at positions substantially equi-angularly spaced from the uppermost point of the wheel 4.

The lever 7 also carries a bias weight 10 which can be moved along the lever 7 by means of a threaded rod 11 engaging with a threaded bore 12 of the weight 10. The rod 11 is disposed between the side plates 13 and has a knob 14 at its free end, so that when the knob 14 is rotated the weight 10 is moved longitudinally of the lever 7, the weight 10 being prevented from turning with the rod 11 by reason of its engagement with the side plates 13. The degree of bias produced by the weight 10 is dependent on the position of the weight 10 along the lever 7, which position can be read from a graduated scale 15.

A combined speedometer and odometer 17 of conventional construction is also provided and is driven from the wheel 4, the dial of the speedometer and odometer being mounted on the frame 1 just below the handlebar.

The ability to change gear as well as the ability to vary the load applied to the wheel ensures that the user of the apparatus can go through a programme or series of exercises simulating open road conditions. In addition, the user can be given a programme that is best suited to his physical condition and can change the programme, if desired, on a daily basis.

I claim:

1. A cycling exerciser comprising a frame, a wheel rotatably mounted in the frame, a pedal-operated chain drive mechanism for the wheel, a lever pivotally mounted on the frame above the axis of rotation of the wheel, a sub-frame pivotally mounted at its center on the lever directly above the axis of the wheel, two rollers rotatably mounted one at each end of the sub-frame, a weight mounted on the lever to bias the two rollers into engagement with the periphery of the wheel at positions above the axis of the wheel which are equiangularly spaced from the uppermost point of the wheel, and means for moving the weight along the lever for adjustment of the bias.

2. A cycling exerciser according to claim 1, wherein the weight has threaded engagement with a rod rotatable relative to the lever, rotation of the rod effecting movement of the weight along the lever.

3. A cycling exerciser according to claim 1, wherein the chain drive mechanism incorporates a gear-change mechanism.

4. A cycling exerciser according to claim 1, including a speedometer operatively coupled to the wheel.

5. A cycling exerciser according to claim 1, including an odometer operatively coupled to the wheel.

* * * * *